US005099775A

United States Patent [19]

Jimenez et al.

[11] Patent Number: 5,099,775

[45] Date of Patent: Mar. 31, 1992

[54] DEVICE FOR MEASURING THE PASSAGE OF A PREDETERMINED LENGTH OF CLOTH AT RIGHT ANGLES TO THE NEEDLE OF A SEWING MACHINE

[75] Inventors: Antonio Jimenez, Meyrin; Gino W. Michelizza, Chatelaine, both of Switzerland

[73] Assignee: Mefina SA, Switzerland

[21] Appl. No.: 443,358

[22] Filed: Nov. 30, 1989

[30] Foreign Application Priority Data

Nov. 30, 1988 [CH] Switzerland ..... 4445/88

[51] Int. Cl.[5] ..... D05B 3/06; D05B 69/18

[52] U.S. Cl. ..... 112/277; 112/447; 33/773; 33/775

[58] Field of Search ..... 112/447, 446, 264.1, 112/275, 277, 272, 121.11, 65; 33/735, 736, 743, 775, 700, 732, 734, 739, 772, 773

[56] References Cited

U.S. PATENT DOCUMENTS 4,232,617 11/1980 Garron ..... 112/447
4,343,249 9/1982 Takenoya ..... 112/314 X
4,393,797 7/1983 Marsh ..... 112/264.1 X
4,398,348 8/1983 Bergvall et al. ..... 112/121.11 X
4,409,913 10/1983 Adams et al. ..... 112/447
4,622,910 11/1986 Hangarter et al. ..... 112/447

*Primary Examiner*—Peter Nerbun
*Attorney, Agent, or Firm*—Cushman, Darby & Cushman

[57] ABSTRACT

A device for measuring the passage of a predetermined length of cloth at right angles to the needle of a sewing machine comprises a frame carrying an arm mounted about a shaft and urged resiliently towards the cloth by a spring adapted to put a pinion in contact with the cloth. A shaft carries a barrel in contact with a gear fixedly connected to the pinion, the barrel enclosing a spring. The barrel is connected to a terminal by a sliding contact and carries a pin which extends into an arcuate groove in a drum while passing through an arcuate aperture in a plate. Contact elements are disposed at one end of the groove and at one end of the arcuate aperture, the pin being able to move from one to the other of these contact elements. The contact elements press against the internal surface of a metallic ring carried by the drum, the external surface of this ring being connected to a second terminal by a sliding contact.

5 Claims, 4 Drawing Sheets

DEVICE FOR MEASURING THE PASSAGE OF A PREDETERMINED LENGTH OF CLOTH AT RIGHT ANGLES TO THE NEEDLE OF A SEWING MACHINE

BACKGROUND OF THE INVENTION

1. Field of the invention

The present invention relates to a device for measuring the passage of a predetermined length of cloth at right angles to the needle of a sewing machine comprising, on the one hand, a pair of reference points each forming an electrical contact member, an adjusting member for varying the distance between these reference points, these being intended to fix respectively the start and the end of the length to be measured, and, on the other hand, a contact closing member disposed between these reference points, a movable part fixedly associated with one of the contact members, the pair of reference points, or the contact closing member, means for putting this movable part in contact with the cloth to be sewn and for causing its movement as a function of the advance of this cloth, and a return member constantly tending to bring this movable part back into a position in which the reference point fixing the start of the length to be measured and the said contact closing member are applied one against the other.

2. Description of the prior art

Numerous devices associated with a control circuit of a sewing machine have already been proposed for measuring a predetermined length of cloth. The electrical signals indicating to the control circuit respectively the start and the end of the passage of a predetermined length of the cloth at right angles to the needle of the sewing machine may be generated by mechanical, magnetic, electro-optical or electrical means. The advantage of electrical means is in not having to depend on an intermediary and in acting directly on the electrical control circuit of the machine, this constituting an increase in precision and operating security which is not to be found with the other above-mentioned means.

Such a device has previously been proposed in U.S. Pat. No. A-4 409 913 for sewing buttonholes. For this purpose the bar of the presser foot is electrically conductive and is connected on the one hand to a terminal of the control circuit of the machine and, on the other hand, to a first contact element, secured to the presser foot. A second contact element, insulated from the first and also integral with the presser foot, is connected to the other pole of this control circuit by a wire passing through the interior of the tubular rod of this foot. These two contact elements are each provided with a sliding contact, which is in contact with an insulating track formed by two slide blocks, the first of which is slidingly mounted on the presser foot of the material presser and is adapted to be drawn along by the advance of the cloth. This first slide block carries a conductor disposed transversely to the insulating track, a second similar conductor being carried by the second slide block, which is adjustable by sliding on the first to determine the length of the path of the cloth. When the contact elements meet one or the other of the conductors, the two terminals of the control circuit are connected and the signal indicates that the measuring device is to be found at one or the other end of the length of the desired path for the sewing of the cloth.

In the solution proposed, the conductive reference points integral with the respective slide blocks are, from the electrical point of view, passive elements, as they are not directly intended to be connected to the control circuit, but are indirectly connected when the contact elements meet. This solution, in which the two contact elements are integral with the same element, necessitates insulating them from each other multiplying the number of parts necessary and increasing the assembly time. It is easily understood that this solution was adopted in the case where it would have been even more complicated to connect the reference points integral with the slide blocks to one of the terminals of the control circuit. Another inconvenience of this device resides in the fact that it is relatively cumbersome and that, to come into contact with the cloth, it is necessary to pinch the portion of cloth to be sewn, which complicates the work of the operator.

BRIEF SUMMARY OF THE INVENTION

An object of the present invention is to simplify this device as much from the point of view of its manufacture as from its use and to make it less cumbersome.

According to the invention, there is provided a device for measuring the passage of a predetermined length of cloth at right angles to the needle of a sewing machine, comprising on the one hand a pair of reference points, each forming an electrical contact member, an adjusting member for varying the distance between these reference points, the reference points being adapted to fix respectively the start and the end of the length to be measured, and, on the other hand, a closing member for the contacts, disposed between the reference points, a movable part fixedly associated with one of the contact members, with the pair of reference points or with the closing member for the contacts, means for putting the movable part into contact with the cloth to be sewn and for causing movement of the movable part as a function of the advance of this cloth, and a return member constantly tending to bring the movable part back into a position in which the reference point fixing the start of the length to be measured and said closing member for the contacts are applied one against the other, wherein the pair of reference points, on the one hand, and the closing member for the contacts, on the other hand, are adapted to be connected respectively to two terminals of a control circuit of the machine.

BRIEF DESCRIPTION OF THE DRAWINGS

Other advantages of the device which is the subject of this invention will appear in the light of the description which will follow and from the attached drawings which illustrate, schematically and by way of example, an embodiment.

DETAILED DESCRIPTION OF THE DRAWINGS

Figure 1:
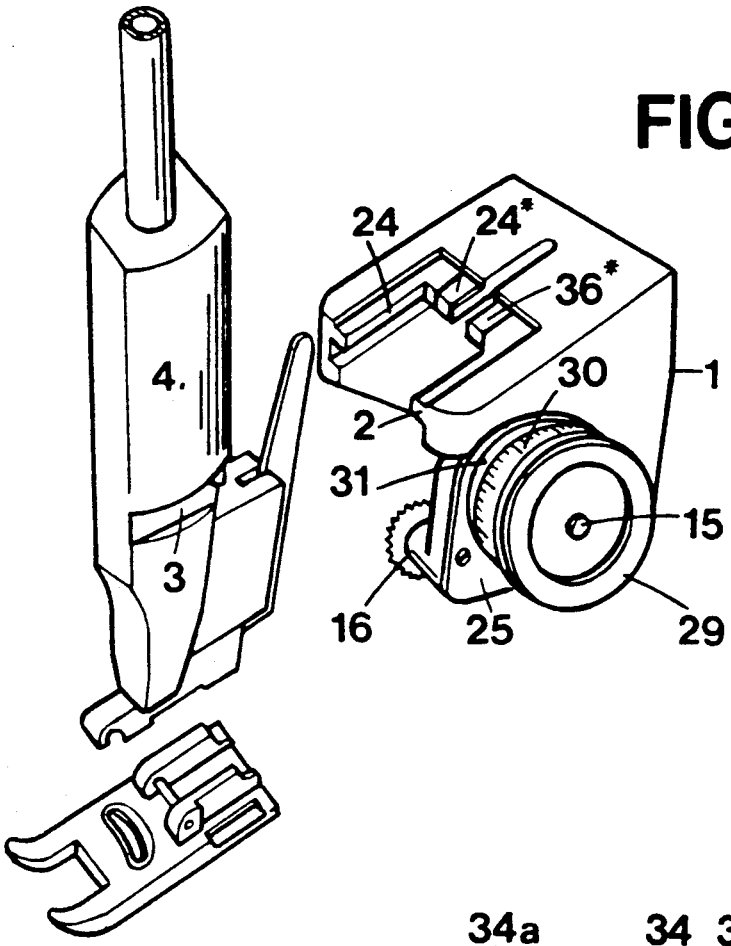
FIG. 1 is a view in perspective of a presser foot and of an embodiment of the device adapted to be connected to this foot in a detachable manner.

The device for measuring the passage of a predetermined length of cloth at right angles to the needle of the sewing machine comprises a frame 1 provided with two slides 2 adapted to engage frictionally in two grooves 3 provided on the presser foot 4 of the sewing machine.

This frame has two side plates 1*a*, 1*b*, in which a shaft is mounted. This shaft 5 extends freely through a cylinder 7 integral with an arm 8 carrying the length measuring mechanism which will be described hereinafter. The cylinder 7 carries at one end an eccentric pin 9 which penetrates into an opening 10 in the side plate 1*a*. A coil spring 11, disposed in a recess of the frame 1, presses against a surface of the arm 8, applying the eccentric pin 9 against the opening 10, thus limiting the downward displacement of the arm 8 with respect to the frame 1.

This arm 8 carries a fixed rod 15 which extends laterally towards the exterior, as well as two pinions 16 and 17 fixedly mounted on a common shaft 18 rotatably mounted in a bore in the arm 8, parallel to the fixed rod 15. The diameter of the pinion 16 is greater than that of the pinion 17.

The fixed rod 15 is adapted to receive a barrel 19 having gear teeth 21 meshing with those of the pinion 17 and enclosing a spiral spring 20 whose inner end is attached to a hook 22 fixed to this rod 15, while its outer end is fixed to the internal cylindrical surface of the barrel 19. This barrel 19 also carries, on its external surface, a pin 23 which extends parallel to its axis.

The frame 1 and the arm 8 are of insulating plastics material, while the barrel 19 and its pin 23 are of metal. A metallic sliding contact 24 adapted to be connected to one of the terminals of a control circuit of the machine which will be described later, is fixed to the insulating frame 1 and is adapted to press resiliently on the non-toothed side surface of the barrel 19, to connect it to this terminal of the control circuit. Accordingly a terminal 24* of this sliding contact 24 is located on a surface of the frame 1 adapted to come into contact with a conductor (not shown) carried by the presser foot 4.

A plate 25 (FIGS. 1, 2 and 3) of insulating material is provided with a central aperture for passage of the fixed rod 15 and is provided with an aperture 27 in the form of an arc of a circle centered on the central aperture for the passage of the pin 23 of the barrel 19. This plate 25 is fixed to the arm 8 by means of two screws 26 and carries a resilient electrical contact member 28, disposed at one end of the arcuate aperture 27, and having a branch 28*a* which extends into an annular groove 25*a*.

Figure 4:
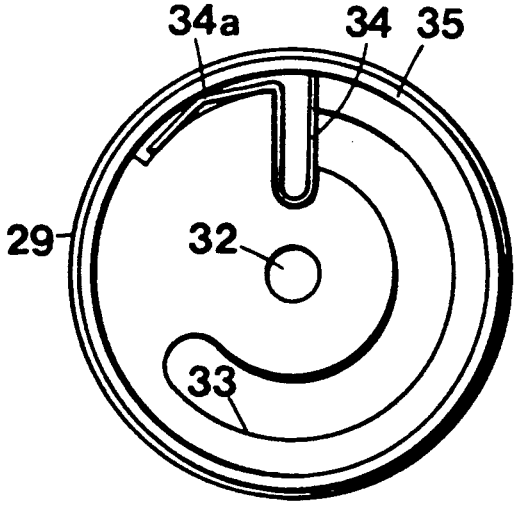
FIG. 4 is a sectional view on the line IV—IV of FIG. 2.

A drum 29, provided with an axial aperture 32 (FIG. 4), is rotatably mounted on the fixed rod 15. This drum includes, on its external cylindrical surface, a graduated scale 30 (FIG. 1) which may be displaced relative to a reference mark 31 which is shown on an edge of the plate 25. This drum also includes a groove 33 in the form of an arc of a circle centered on the axial aperture 32. A resilient contact member 34 is disposed at one end of this groove 33. This drum 29 is of an electrically insulating material, such as a plastics material, and it carries a metallic ring 35 which projects axially and against the internal face of which there presses a branch 34*a* of the contact member 34, as well as the branch 28*a* of the other contact member 28 associated with the plate 25, when the drum is mounted on the fixed rod 15 and the projecting part of the metal ring 35 penetrates into the annular groove 25*a*. A sliding contact 36 presses resiliently against the external surface of this metal ring 35 and is connected to the second terminal of the control circuit by its terminal 36* which is adapted to come into contact with a conductor (not shown) carried by the presser foot 4. Consequently, the contacts 28 and 34 are connected to one and the same terminal, while the barrel 19 and its pin 23 are connected to the other terminal. A fixed stop 37 extends out from the plate 25; it is adapted to penetrate into the arcuate groove 33 of the drum 29 to limit its angular movement.

Figure 2:
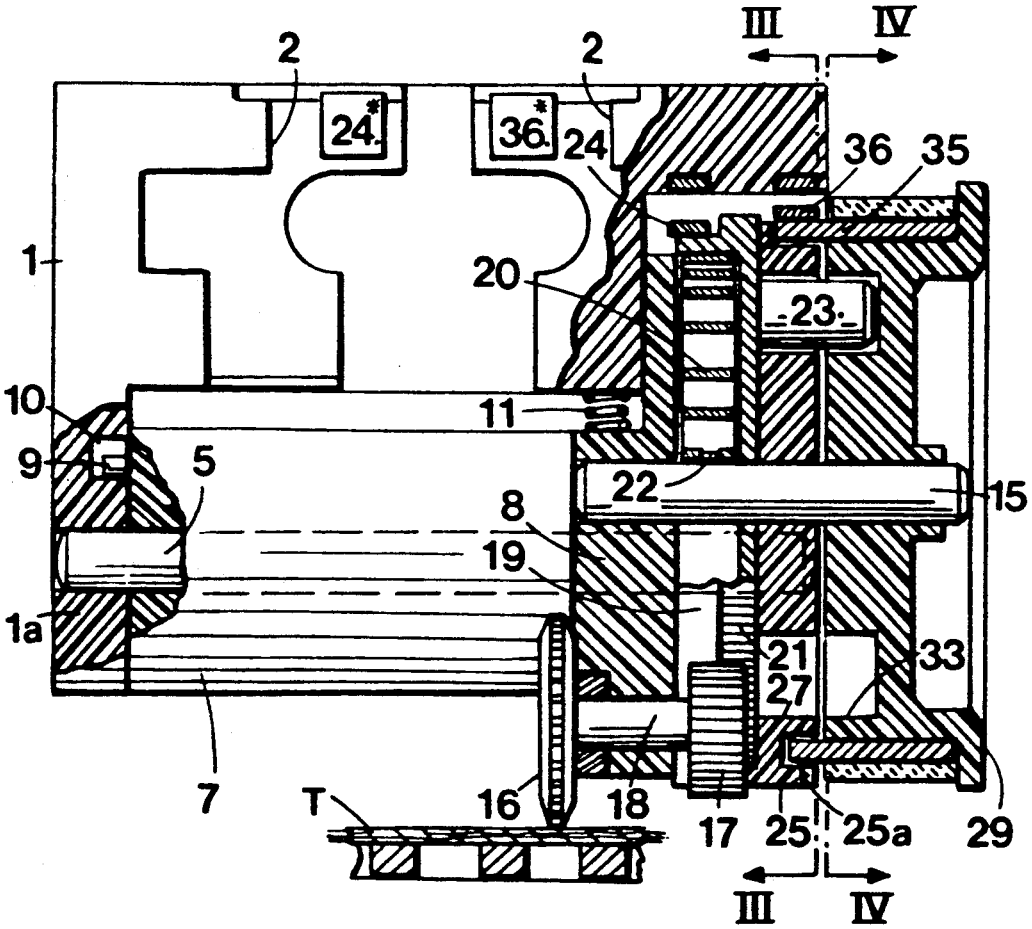
FIG. 2 is a sectional view of this device on the line II—II of FIG. 3.
Figure 3:
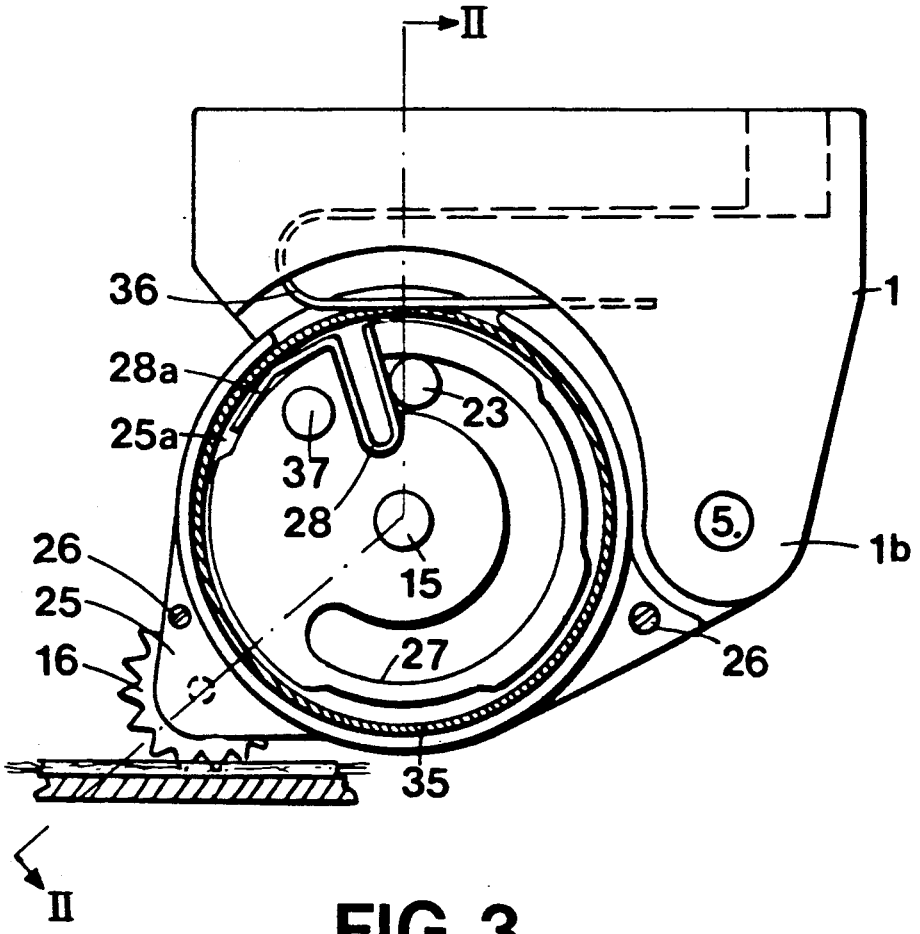
FIG. 3 is a sectional view on the line III—III of FIG. 2.

When the different elements of the measuring device described are assembled on the fixed rod 15 of the arm 8, as illustrated in FIG. 2, the pin 23 of the barrel 19 passes through the arcuate aperture 27 and penetrates into the arcuate groove 33.

Figure 5:
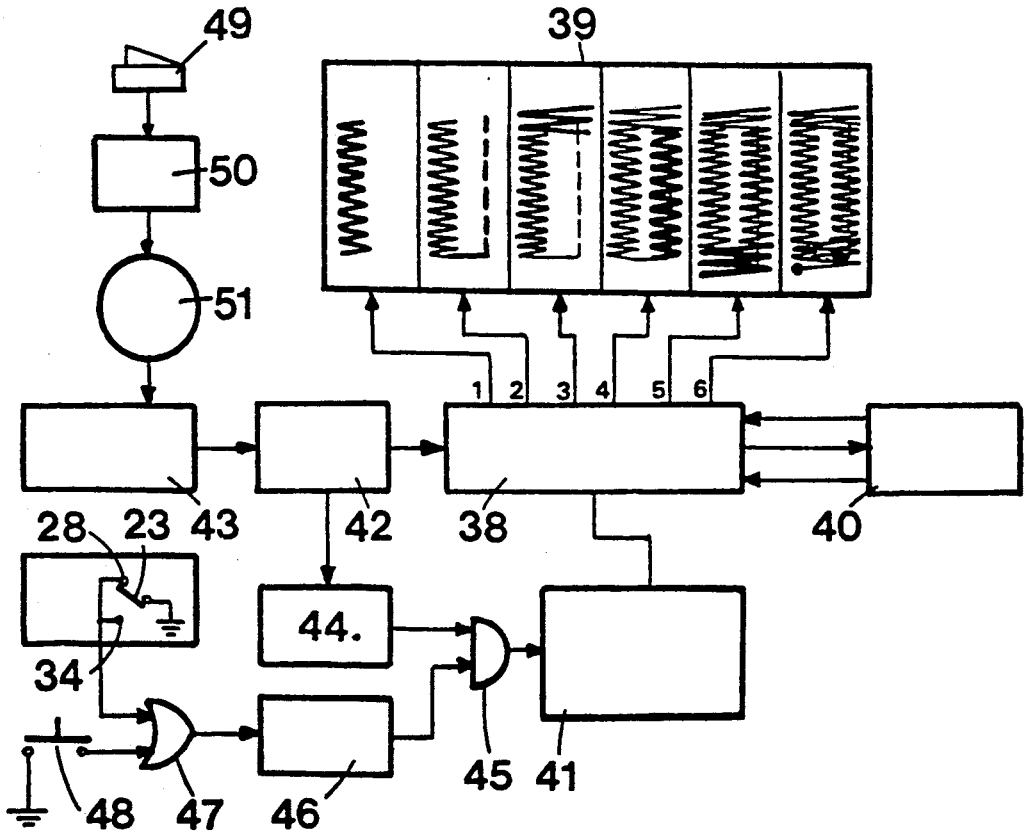
FIG. 5 is a control block diagram for an electronic sewing machine having a memory.

The block diagram of FIG. 5 illustrates an example of the use of the measuring device described hereinabove, applied to the manufacture of a buttonhole, it being understood that this measuring device may be used for the manufacture of all kinds of patterns, for example, for the repetition of a seam of constant length.

This block diagram shows a phase address memory 38 for different phases of the buttonhole, in this example these are six in number, illustrated by a portion of the electronic memory 39. The phase address memory 38 is connected to a memory selection 40 which allows a choice of the type of buttonhole in this memory and a choice between an automatic mode or a manual mode, this latter involving the machine stopping after each phase of the program stored in the electronic memory 39. This phase address memory 38 is also connected to a phase address counter 41 and to a counter 42, which is connected to a position detector 43 of the needle bar (not shown) and which provides a pulse each time a stitch is terminated.

This counter 42 is also connected to a block 44 adapted to transmit its pulse to one of the inputs of an AND logic element 45 whose output is connected to the phase address counter 41 and whose second input is connected to a pulse generator block 46, itself connected to the output of an OR logic element 47 whose inputs are connected, on the one hand, to the control device described hereinabove and whose contact elements 23, 28, and 34 have been represented in a rectangle symbolizing this device, and, on the other hand, to a manual contact 48 in the case where the memory selection 40 was chosen to form the buttonhole manually, that is to say where the start of each phase is controlled by the operator.

There is also represented on this block diagram a pedal 49 connected to a control unit 50 for a driving motor 51 of the machine.

To proceed with the sewing of a buttonhole using the measuring device described, the operator chooses the length of the buttonhole using the drum 29 by turning the graduated scale 30 until the value of this length is to be opposite the reference mark 31. Then the operator selects the type of buttonhole as well as the means of effecting it (automatic or manual) by use of the memory selection 40, and, from that moment, the sets the machine in motion by actuating the pedal 49. The machine then carries out phase one of the program stored in the electronic memory 39.

As the cloth T is advanced, the pinion 16 which presses resiliently against it is caused to turn, so that the pinion 17, which engages with the barrel 19, causes, on the one hand, the angular displacement of the pin 23 in the direction of the contact member, 34 associated with the drum 29 and, on the other hand, the compression of the spiral spring 20, whose internal end is secured to the fixed rod 15.

When the pin 23 meets the contact member 34, a pulse is produced by the pulse generator 46 and transmitted to the AND logic element 45. Given that this pulse may occur before the end of a stitch, the position detector 43 of the needle bar communicates to the counter 42 the moment when the stitch in the process of being made is terminated. At this moment, a pulse appears at the output of the block 44, so that the AND logic element 45 produces a signal which it transmits to the phase address counter 41, which indicates to the phase address memory 38 the end of the phase in progress. If the operator has chosen an automatic work mode, the phase address memory 38 switches over the electronic memory 39 to phase two and restarts the sewing process which had been interrupted at the end of phase one. In the case of the work mode known as "manual", the operator must activate the manual contact 48 to start the next phase.

The machine brings the cloth T back while forming a straight seam parallel to the zig-zag seam of phase one. As the pinion 16 has not left the cloth, it is turned in the opposite direction, bringing the pin 23 towards the contact 28 and relaxing the spring 20.

As soon as this second phase is terminated, by the meeting of the pin 23 and the contact member 28 and the indication, by the counter 42, of the end of the stitch in the process of being carried out, the process of starting phase three repeats itself, as in the case of the transition from phase one to phase two described hereinabove. Phases four, five and six are then successively carried out in the same manner, after which the buttonhole is finished. By lifting the presser foot 4 of the machine, the pinion 16 is freed, allowing the spring 20 to bring the barrel 19 back to its initial position with the pin 23 against the contact member 28.

By virtue of, in particular, the spring 20 which brings the barrel 19 and its pin 23 back to their starting positions as soon as the pinion 16 is disengaged from the cloth, this device may be used to repeat any pattern whatsoever of the same length predetermined by the position of the graduated scale 30 of the drum 29. In effect, once the length is chosen on this graduated scale 30, this stays in this position, and the pin 23 moves from the fixed contact member 28 to the contact member 34 secured to the drum 29. As soon as the presser foot 4 is raised, this pin 23 is brought against the contact member 28 without the graduated scale 30 moving, so that the same length of seam may be repeated as long as the position of the graduated scale 30 of the drum 29 is not changed.

We claim:

1. A device for measuring the passage of a predetermined length of cloth at right angles to the needle of a sewing machine, comprising a pair of reference points, each forming an electrical contact member, an adjusting member for varying the distance between said reference points, the reference points being adapted to fix the start and the end of the length to be measured and a further electrical contact member for closing the electrical contact members formed by the reference points, disposed between the reference points, a movable part fixedly associated with one of the group consisting of the pair of reference points and the further electrical contact member, means for putting the movable part into contact with the cloth to be sewn and for causing movement of the movable part as a function of the advance of this cloth, and a return member constantly tending to bring the movable part back into a position in which the reference point fixing the start of the length to be measured and said further electrical contact member are applied one against the other, wherein the pair of reference points and the closing further electrical contact member are adapted to be connected respectively to two terminals of a control circuit of the machine.

2. A measuring device according to claim 1, wherein the pair of reference points and the further electrical contact member for closing the electrical contact members formed by the reference points are connected to two terminals of said control circuit of the machine by the intermediary of two circular tracks, rotatably mounted about a common shaft and respectively associated with two conductive sliding contacts, one of these tracks being fixedly associated with said movable part, while the other is fixedly associated with one of said reference points and forms said adjusting member for varying the distance between these reference points.

3. A measuring device according to claim 2, wherein said common shaft carries said movable part, which is provided at its periphery with one of said tracks and one axial surface of which carries said further electrical contact member, said common shaft being moreover fixedly associated with an insulating plate through which there extends an aperture in the form of an arc of a circle centered on the shaft and adapted for the passage of said further electrical contact member, and at one end of which there is located one of said reference points, and said common shaft also carries a movable length regulating member of insulating material mounted pivotably and comprising, on one face adjacent to said insulating plate, a circular groove concentric with and of the same radius as the arcuate aperture, for receiving said further electrical contact member, the second of said reference points being disposed at one end of said groove, and a metallic ring projecting axially to engage in a corresponding opening of said insulating plate, to come in contact with a portion of each of the said reference point and with the one of said conductive sliding contacts adapted to be connected to the other terminal of said control circuit.

4. A measuring device according to claim 3, wherein said movable part is formed by a drum enclosing a spiral return spring whose inner end is fixed to said common shaft and whose outer end is fixed to the inside surface of the drum, an outside surface of the drum defining gear teeth in contact with a pinion fixedly associated with a shaft parallel to said common shaft, said parallel shaft being rotatably mounted and fixedly associated with a second pinion of greater diameter than the first pinion and adapted to come into contact with the cloth to be sewn.

5. A measuring device according to claim 2, wherein said common shaft is fixedly associated with an arm pivoted about a shaft which is parallel to said common shaft and the angle of pivoting of the arm towards the cloth is limited by a stop, resilient means constantly tending to urge the arm towards the stop.

* * * * *